US005842372A

United States Patent [19]

Madden

[11] Patent Number: 5,842,372

[45] Date of Patent: Dec. 1, 1998

[54] TOOL FOR FORMING A MASON'S TRIG AND METHOD

[75] Inventor: Richard C. Madden, Pleasant Hope, Mo.

[73] Assignee: Charlotte L. Madden, Shady Cove, Oreg.

[21] Appl. No.: 958,043

[22] Filed: Oct. 27, 1997

Related U.S. Application Data

[60] Provisional application No. 60/029,180.

[51] Int. Cl.[6] ..... B21D 17/02

[52] U.S. Cl. ..... 72/414; 72/304; 72/322; 72/461

[58] Field of Search ..... 72/414, 461, 322, 72/316, 308, 304, 458, 412, 293; 140/87, 106

[56] References Cited

U.S. PATENT DOCUMENTS

| | | | |
|---|---|---|---|
| 233,751 | 10/1880 | Haworth | 72/322 |
| 3,020,590 | 2/1962 | Siegert | 72/322 |
| 3,120,257 | 2/1964 | Webers | 72/458 |
| 3,352,142 | 11/1967 | Marra | 72/412 |
| 3,706,121 | 12/1972 | Gillespie | 72/411 |
| 3,961,387 | 6/1976 | Porter | 7/5.6 |
| 4,285,139 | 8/1981 | Huston | 33/407 |

*Primary Examiner*—Daniel C. Crane
*Attorney, Agent, or Firm*—Jonathan A. Bay

[57] ABSTRACT

A hand tool is disclosed for producing trigs from flat metal strips. The hand tool has a pair of opposite press blocks or "jaws." One jaw serves as a base. It has a loop affixed in it for receiving an insertion portion of the strip. It also has appropriate guides and stops for promoting proper location of the insertion portion and preventing its untimely dislocation. The other jaw has a corner edge which when the jaws are closed on the single ply of the insertion portion, forms the outer limit of the insertion portion and allows for initiating bending of the remaining portion of the strip back upon the insertion portion. The other jaw also is formed with a slot to match the loop such that when the jaws are closed on the two plies of the insertion portion and bent-back remaining portion together, light hammering on the jaws will substantially flatten out the insertion and remaining portions tightly against each other as well as form a flute in the remaining portion that conforms closely to what interspace is defined between such loop and slot. This flute serves as a well-formed guide-string eye for a mason's guide string.

20 Claims, 4 Drawing Sheets

TOOL FOR FORMING A MASON'S TRIG AND METHOD

CROSS-REFERENCE TO PROVISIONAL APPLICATION(S)

This application claims the benefit of U.S. provisional application No. 60/029,180, filed Oct. 28, 1996.

BACKGROUND AND SUMMARY OF THE INVENTION

The invention generally relates to a forming tool for use by masons including but not limited to bricklayers or the like, and, more particularly to a forming tool for press-forming a mason's trig.

As masons know, a "trig" is relatively small prop or clip, usually made from light-gauge steel band material or the like, used to support or prop a guide string that marks a straight and level course by which to lay bricks or concrete blocks and the like. As a matter of non-standard terminology, some masons call trigs "twigs." Trigs are used generally as follows Concrete blocks or bricks are usually (but not always) laid in straight courses, one course on top of another, in progressive layers to build planar walls and the like. A mason typically sets up a guide string, stretched level and tight across the span of the course, to aid him or her in aligning the blocks or bricks straight and level along the course. Trigs are used to support or prop these guide strings at several points along mid-span of the string because, especially for long courses, the trigs lift the sag out of the string.

Trigs are neither frail nor limited to a single use, but trigs are easily lost or deformed beyond usability. Hence a mason would like to keep a good supply on hand for replacements. The forming tool in accordance with the invention allows a user to form his or her own trigs for economy and convenience in producing a good and sufficient supply of trigs. A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
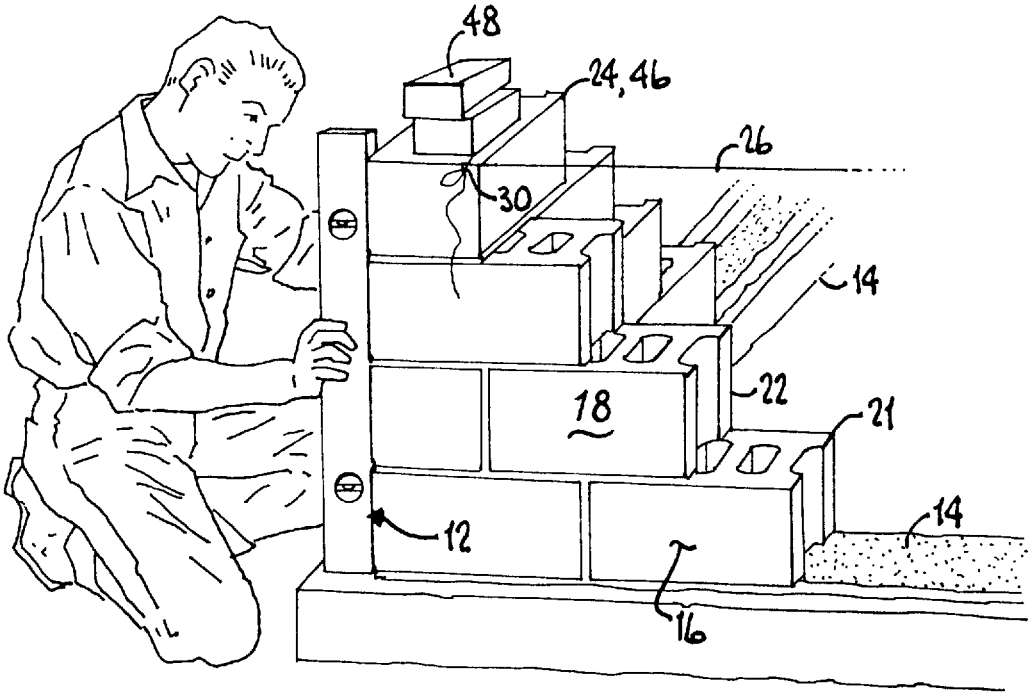
FIG. 1. (PRIOR ART)
FIG. 1 is a perspective view of a conventional masonry job in progress in which a mason is erecting a concrete block wall, wherein a guide string is set up and attached at one end to a trig to give a generalized illustration of the use thereof.

FIG. 1 shows a conventional masonry job site. A mason is kneeling at a corner 12 of a building foundation. The corner 12 is defined by a footing 14 extending away to the right as well as away into the depth of the view of FIG. 1. The mason is preparing to build at least two vertical walls intersecting one another at the corner 12. There are two wall portions in view in FIG. 1, and of those two wall portions, the wall portion that is in frontal view in FIG. 1 is arbitrarily referred to in this description as the front wall 16.

The mason has built up the corner 12 only as far as an elevation of three or four layers of concrete blocks 18. The mason is checking the vertical alignment of the corner 12 with a level. More significantly, the mason has set up a guide string 26 at the elevation of the fourth layer 24 to check whether the first four courses (or layers) of the front wall 16 will extend appropriately straight and horizontal relative to the right-side terminus (not shown, it being out of view in FIG. 1) of the front wall 16. It is the stretched out guide string 26 that allows the mason check and align the first four courses (i.e., layers) for straightness as well as horizontal levelness. The guide string 26 is attached at one end to a conventional trig 30.

Figure 2:
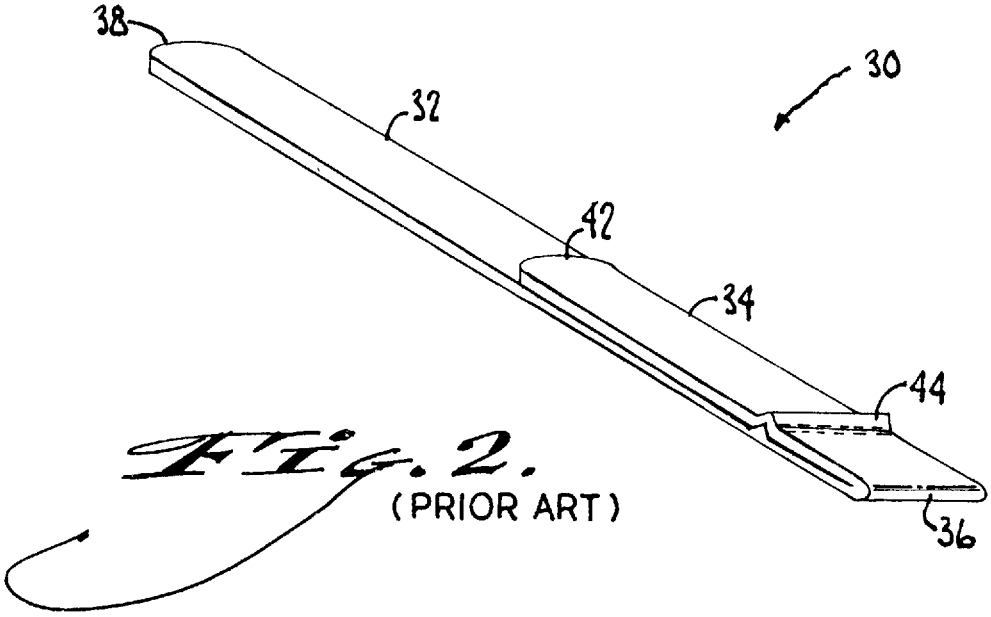
FIG. 2. (PRIOR ART)
FIG. 2 is an enlarged perspective view of a conventional trig.

FIG. 2 shows the characteristics of a conventional trig 30. The trig 30 is generally a small prop or clip, and typically can be formed from flat steel band material. The overall length of conventional trigs 30 generally is in the neighborhood of about 10 cm (4 inches). A suitable stock of steel band material includes without limitation the steel banding material conventionally used to bind bricks or concrete blocks together on pallets for delivery to a job site from a supply yard (not shown). Even though a thinner gauge band material would be preferred over the last-mentioned banding material, the non-preferred banding material is (as said) suitable for the purpose, and it certainly is plentiful on the job site.

The trig 30 comprises a shank portion 32 and a tab portion 34 folded 180° back onto the shank portion 32 at a fold line 36. The shank portion 32 terminates in a base end 38 as the tab portion 34 terminates in a tab end 42. One of the shank portion 32 or tab portion 34 is formed with a crease or flute 44 (in FIG. 2, it is the tab portion 34 that is so formed), which flute 44 defines an eye. The trig 30 carries the string by way of having the string extend through the eye 44.

This trig 30 in FIG. 2 illustrates several features of a well-formed trig. The shank and tab portions 32 and 34 are substantially planar and not warped, bowed or twisted. Also, in consideration that the shank and tab portions 32 and 34 define a given longitudinal axis of symmetry (this reference axis is not referenced nor given a designation), then another important feature of a well-formed trig is that, the flute 44 is substantially perpendicular that longitudinal axis. Additionally, the shank and tab portions 32 and 34 substantially rest upon or abut each other so that the flute 44 defines a well-formed eye. That way, the guide string is more properly carried in the flute 44 and is not free to move out of the flute 44.

Referring back to FIG. 1, the following aspects of how trigs are used by masons are now apparent. The mason has rested the base end of the trig 30 on a given concrete block 46 (i.e., a block in the fourth layer 24 up). He has piled some weight 48 on the base end of the trig 30 to cantilever the trig 30 with the flute positioned in front of the front wall 16 some 2–5 cm or so (1–2 inches). As shown in FIG. 1, the pile of weight comprises a pair of bricks 48. The mason has tied one end of the guide string 26 to the trig 30 (the opposite end of the guide string 26 is tied off suitably at some location at the right terminus of the front wall 16, which is not shown in FIG. 1). This arrangement of the guide string 26 aids the mason in extending his first four courses (or layers) of the front wall 16 straight and level in progressing toward the right terminus of the front wall 16 (the right terminus not shown).

Another use of trigs includes the following, which is not shown. After the mason has completed his corner 12, as he is doing in FIG. 1, he would return to completing the first of layer 21 of blocks that rest on the footing 14. In preparation of that, the mason would typically drive a nail (not shown) in the mortar between the between the blocks of the first and second layers 21 and 22, and around the corner 12 from the front wall 16. The nail will allow the mason to tie off the left side of the guide string (he would tie off the right side of the string to a suitable anchor on the right terminus of the front wall, not shown). He would then attend to stretching and/or tensioning the string tight to pull out as much sag as possible.

Tensioning aside, if given a sufficiently long span, the string will still sag. To overcome that problem, the mason will lift the sag out of the string by fastening one or more trigs to the string at spaced points along its span, and then rest the base ends of those trigs on blocks resting on the footing, with piles of weight or bricks resting on the trig base ends. In that fashion the mason lifts the sag out of the guide string.

The mason will likely deploy several trigs for each course of the front wall 16 as he builds. It is expected that the mason will find it necessary to discard, because of loss or damage, a significant percentage of the trigs that he deploys. Hence it is convenient if the mason can keep him or herself well-supplied in trigs for big jobs. A trig-forming tool 50 in accordance with the invention, as shown especially by FIGS. 3 and 4*a*, allows a mason to produce his or her own trigs on the job site (or elsewhere) from waste banding material that otherwise lies around a job site as a nuisance before proper disposal.

Figure 3:
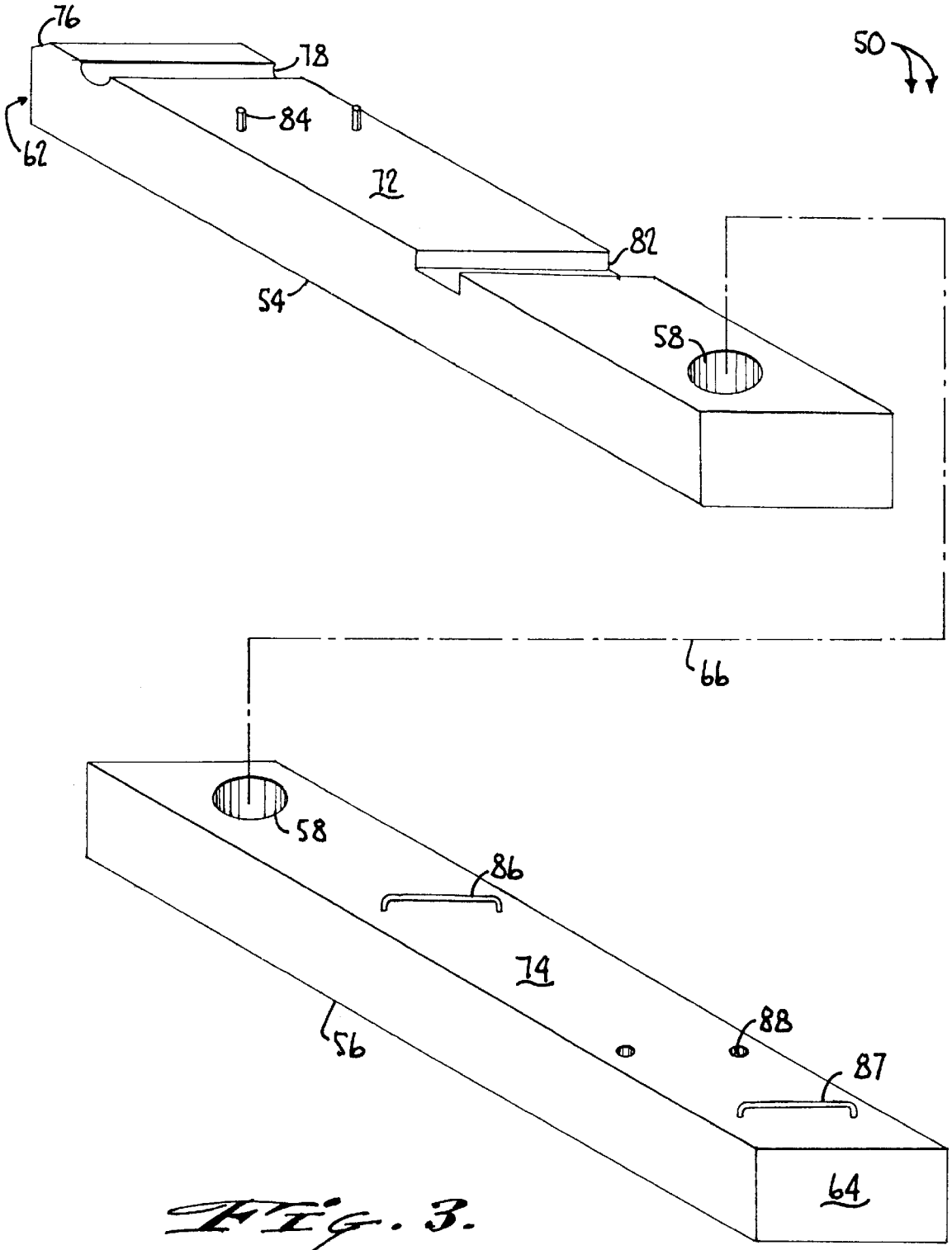
FIG. 3 is an exploded perspective view of a forming tool in accordance with the invention (a bolt and nut being omitted) for producing trigs; and, FIGS. 4*a* through 4*f* are a series of action sequence, side elevational views of the forming tool in accordance with the invention, as shown in various changed positions from one view to the next, to illustrate how to use the forming tool to produce a trig (that resembles the trig shown by FIG. 2) from a stock piece of flat steel band.
Figure 4A:
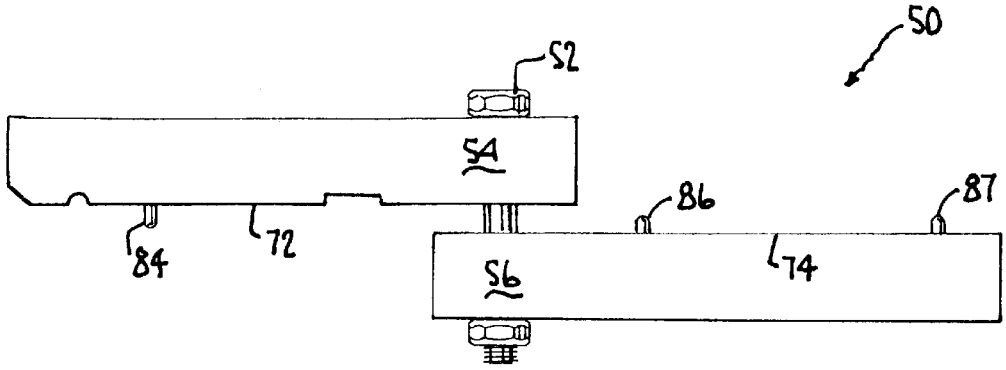

In FIG. 3, the forming tool 50 is shown disassembled. FIG. 4*a* shows the forming tool assembled by a bolt and nut (which bolt and nut 52 are not shown in FIG. 3). The forming tool 50 comprises mating blocks or "jaws" 54 and 56. In FIGS. 3 though 4*f*, the blocks (or jaws) 54 and 56 are shown oriented horizontal, and one block 54 is consistently depicted in an upper position relative to the other block 56, which is consistently depicted in a base or lower position. However, the trig-forming tool 50 can be handled and used in various orientations, and accordingly, terms like "upper" and "lower," "base," "on top" and "underneath" and like terms referring to spatial orientation, are used merely for convenience in this description and do not limit the invention to a particular orientation for use thereof nor in the construction thereof.

The blocks 54 and 56 are bars cut from 2.5×1.25 cm (1×½ inch) aluminum bar stock (although any suitable material will do). Each block 54 or 56 extends between a pivot end formed with a through-hole 58, and, an opposite free end 62 or 64. The through-holes 58 allow the blocks 54 and 56 to be assembled together by the bolt and nut 52 (not shown, but see FIG. 4*a*). The upper block 54 is shown inverted relative to how it must be flipped to bolt together with the lower block 56. This inversion is shown by the dot-dash line 66 through the centers of the through-holes 58.

Each block 54 and 56 has a partition face 72 and 74, respectively. In FIG. 3, the partition faces 72 and 74 of the blocks 54 and 56 are shown oriented up. In FIGS. 4*a*–4*f*, however, the partition face 72 of the upper block 54 is oriented down. FIGS. 4*c* and/or 4*e* show that the respective partition faces define a partition between the blocks 54 and 56.

The partition face 72 of the upper block 54, at the free end 62, is formed with a chamfer 76. It is also formed with a semi-cylindrical slot 78, a relatively wider rectangular slot 82, as well as a pair of alignment pins 84 positioned between the spaced slots 78 and 82.

Figure 4B:
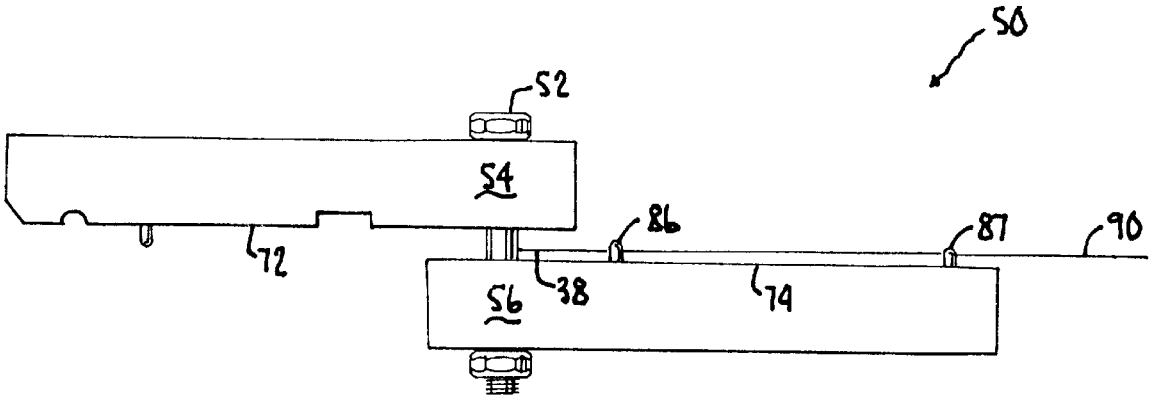
Figure 4C:
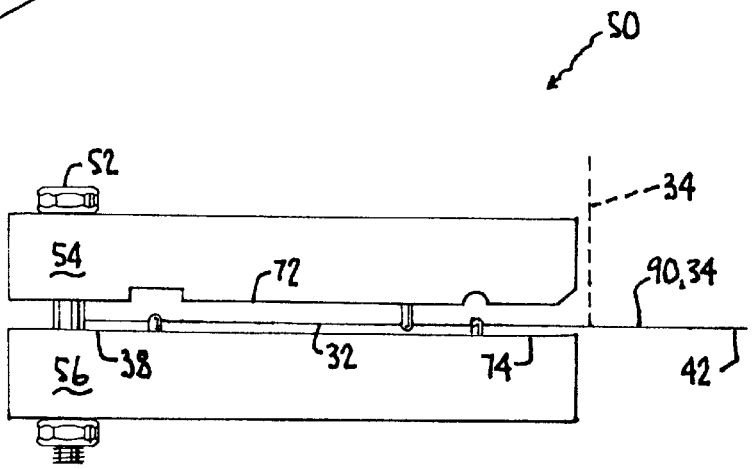
Figure 4D:
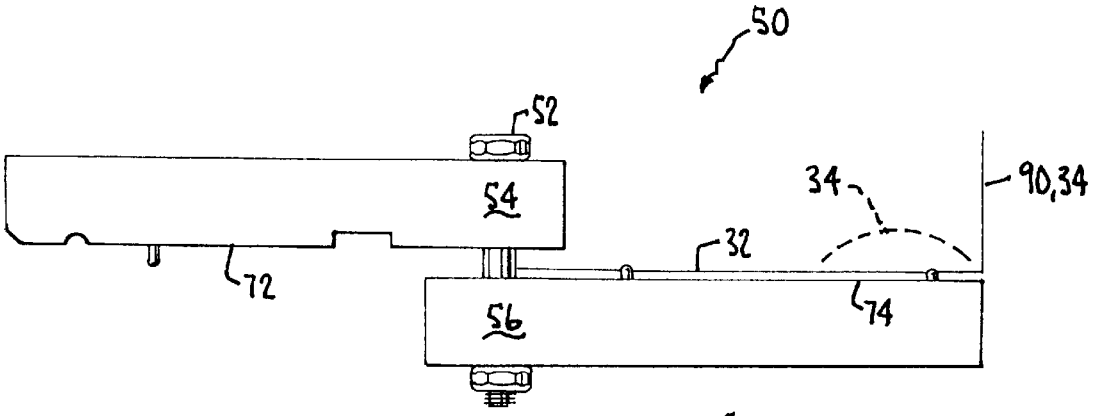
Figure 4E:
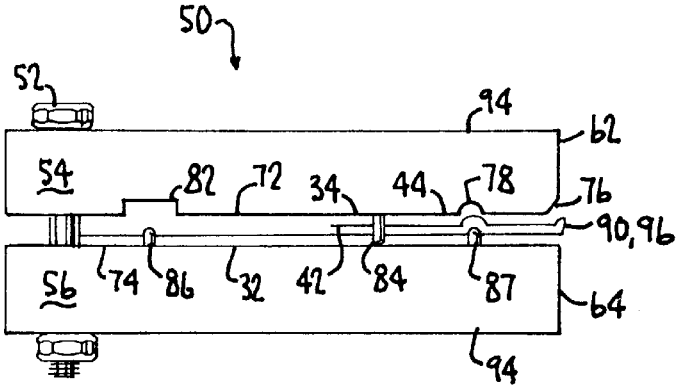

The partition face 74 of the lower block 56 carries a pair of aligned wire loops 86 and 87 spaced relative to each other and relative to the slots 78 and 82 in the upper block 54 such that the wire loops 86 and 87 can nest in the slots 78 and 82 when the forming tool 50 is closed (or substantially closed as shown in FIGS. 4*c* or 4*e*). These wire loops 86 and 87 can be formed from various suitable soft or hard materials including without limitation copper wire. The lower block 56 further includes two small pin holes 88. The pin holes 88 allow removable insertion of the pins 84 from the upper block 54 when the forming tool 50 is closed (i.e., see FIGS. 4*c* or 4*e*).

FIG. 4*a* shows the two jaws or blocks 54 and 56 assembled together by the bolt and nut 52. The bolt and nut 52 allow the blocks 54 and 56 to swing open (i.e., as shown by FIGS. 4*a*, 4*b*, 4*d* and/or 4*f*) and closed (e.g., FIGS. 4*c* or 4*f*) relative to each other.

Figure 4F:
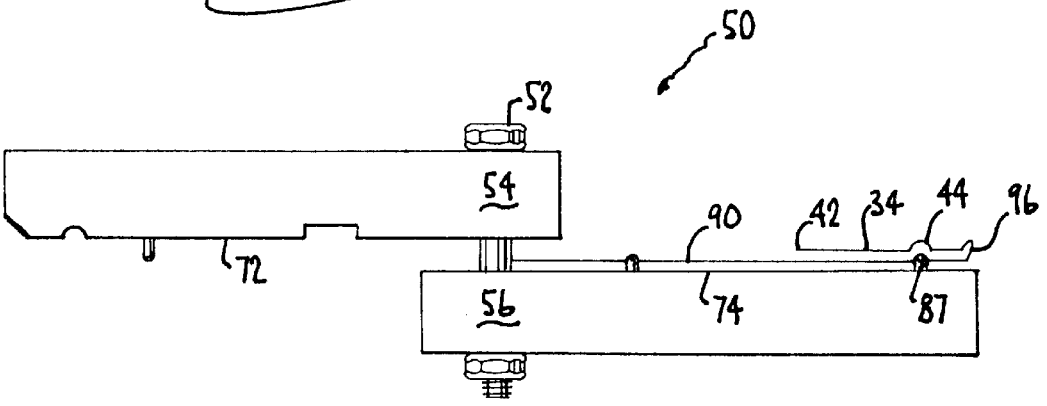

In use, a mason (or any user) would manipulate the twig-forming tool 50 to press-form and/or produce a completed twig 90 as shown by FIGS. 4*e* or 4*f*, in accordance with the following procedure and as generally shown by FIGS. 4*a* through 4*f*.

In storage, the user most likely keeps the forming tool 50 closed with the bolt and nut 52 tightened (not illustrated) to protect the pins 84 and wire loops 86–87 from damage during non-use. To prepare for use, the user would loosen the nut and bolt 52 sufficiently to open the forming tool 50, as shown by FIG. 4*a*. The user can either use a pre-cut band of a preferred gauge of band material (i.e., like the material used to make trig 30 in FIG. 2), or else cut a length of waste banding material to a proper length of about 14 cm (5.5 inches) or so. For convenience of the user in measuring 14 cm (5.5 inches), the length between the free end of the lower block and the rectangular slot in the upper block is 14 cm (5.5 inches). The description that follows assumes that the user is forming the trig from a cut stock of waste banding material unless specifically mentioned otherwise, and this stock is generally given reference numeral 90 in the figures.

In FIG. 4*b*, the forming tool 50 has been opened. A leading or "insertion" portion of the flat stock 90 of banding material is inserted flush along the partition face 74 of the lower block 56, through both wire loops 86 and 87, until the leading or "insertion" end of the banding material limits out against the bolt 52. This end of the banding material 90 that limits out against the bolt will become the base end 38 of the completed trig.

In FIG. 4*c*, the blocks 54 and 56 have been pivoted until the forming tool 50 is substantially closed. The end of the banding material 50 that is opposite to the base end 38, will become the tab end 42 of the completed trig. The insertion portion of the banding material 90 that is clamped between the blocks 54 and 56 of the closed forming tool 50, will become the shank portion 32 of the completed trig. The remainder portion of the banding material 90, or that portion which extends out exposed from the closed forming tool 50, will become the tab portion 34 of the completed trig. The user tightens the nut and bolt 52 lightly, and bends the tab portion 34 into a right angle relative the shank portion 32, as shown in dashed lines.

In FIG. 4*d*, the forming tool 50 is opened, and the user folds over the tab portion 34 onto the shank portion 32 as shown in dashed lines, preferably by hand. In FIG. 4*e*, the user has pivoted the blocks 54 and 56 substantially closed again and then tightened the bolt and nut 52. The user then grips the forming tool 50 by the end having the bolt 52 through it, and rests one of the areas designated by reference numeral 94 on a hard support surface such as a concrete block or brick or any other suitable hard support surface (not shown). The user next takes a hammer and strikes (not shown) the opposite one of the areas 94 to complete press-formation of the trig 90. Experience shows that two or more lighter hammer strikes work better than a single heavy strike. The new trig 90 is thus substantially formed.

The following inventive aspects of the trig-forming tool 50 appear in FIG. 4*e*. The semi-cylindrical slot 78 is appropriately shaped and sized relative its associated wire loop 87 for forming a flute 44 in the tab portion 34 of the trig 90 in accordance with predetermined dimensions. A person having ordinary skill in the art would posses the requisite routine skills to routinely configure and size the wire loop 87 and semi-cylindrical slot 78 accordingly. The rectangular slot 82 is sufficiently large to allow its associated wire loop 86 clearance as the two blocks 54 and 56 are pivoted open and closed as desired. Both wire loops 86 and 87 cooperate to stabilize the positioning of the shank portion 32 of the trig-to-be-formed 90 in a given lateral alignment in the forming tool 50 during the process of forming the trig 90. The wire loop 87 nearer the free end 64 of the lower block 56, however, also functions to form the flute 44 in the tab portion 34. The alignment pins 84 also give lateral stability to the trig-to-be-formed 90 during the process of forming the trig 90. More significantly, though, the alignment pins 84 are positioned so that the tab end 42 extends between the alignment pins 84 in the step of forming the trig 90 that is shown by FIG. 4*e*.

With reference back to slot 82, its purpose again is primarily a clearance slot for wire loop 86 as the blocks 54 and 56 are pivoted opened and closed. Slot 82 is hence not sized or scaled to close tolerances. In fact, in a different version of the invention (not shown), slot 82 is formed in the block 54 by the same router bit as used to form slot 78, except that slot 82 has the shape of a sweeping arc about the axis of the bolt hole 58 (again this is not shown). That way, the two slots 78 and 82 can be formed by the same router bit on a table for forming the block 54 (not shown). Whereas during fabrication of block 54, a fence or a guide is used to give slot 78 its straight course, slot 82 can be formed by locating an alignment pin (not shown) in hole 58 and pivoting the block 54 over the router bit. This allows efficient machining of the two slots 78,82 over one router bit with use of one fence. It eliminates the need for a second fence "set up" to form the slot 82, because as stated slot 82 is allowed looser tolerances than slot 78.

The chamfer 76 in the free end 62 of the upper block 54 allows a small loop 96 to be formed in the fold line of the trig 90. This loop 96 allows relief of stress in the banding material after it is folded 180° upon itself. Without the small loop 96, the banding material would likely be stressed to the point of failing or breaking. This loop 96 will not effectively substitute for the flute 44 in defining an eye for carrying a guide string. The dimensions of this loop 96 are hard to control, and the size of the loop 96 will vary considerably from one trig to the next. It might be noted that, this loop 96 is relatively more important for providing stress relief to trigs formed from waste banding material. Waste banding material comes in a relatively thicker gauge than the preferred material for making trigs. Waste banding material is not sufficiently resilient to allow forming a flat fold line 36 as shown by FIG. 2. As previously mentioned, without the loop 96, waste banding material is likely to break from brittleness.

FIG. 4*f* shows how a user extracts the completed trig 90 from the forming tool 50. The forming tool 50 is opened. The trig 90 should be pried up under the loop 96 to pop it free or otherwise release it from the lower block 56 because the trig 90 tends to adhere to the partition face 74 of the lower block 56 after hammering. Next, the tab end 42 of the trig 90 should be pried apart slightly to allow the flute 44 and tab portion 34 to clear the wire loop 87. After all that, the trig 90 should slide out. The forming tool 50 is thereafter ready for a successive use or, after it closed and secured, storage during non-use.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A tool to make a trig from a metal strip, comprising:

a pair of jaws;

one jaw serving as a base and including a loop for receiving an insertion portion of the strip as well as including setting means for help setting the location of the insertion portion;

the other jaw having bending means which when the jaws are closed on a single ply of the insertion portion, forms an outer limit of the insertion portion with a remaining portion extending therefrom and allows for initiating bending of the remaining portion of the strip back upon the insertion portion;

the other jaw also being formed with a slot to match the loop such that when the jaws are closed on two plies of the insertion portion and bent-back remaining portion together, light hammering on the jaws will form a flute in the remaining portion of the strip that conforms closely to what interspace is defined between the loop and slot.

2. The tool of claim 1 wherein each jaw comprises in form that of a block.

3. The tool of claim 1 wherein the loop forms substantially a rectangular aperture scaled for close fitting insertion of the metal strip.

4. The tool of claim 3 wherein the bending means comprises a corner edge of the other jaw.

5. The tool of claim 1 wherein the setting means includes an end-stop for limiting longitudinal dislocation of the insertion portion.

6. The tool of claim 1 wherein the setting means includes edge-abutting guides for limiting lateral dislocation of the insertion portion.

7. The tool of claim 6 wherein the edge-abutting guides comprise portions on a second loop included on the base jaw.

8. The tool of claim 1 wherein the slot defines a semi-cylindrical form and has open ends.

9. The tool of claim 1 wherein the jaws are shaped and arranged to close substantially planar upon one another such that light hammering on them while closed upon the two plies of the insertion portion and bent-back remaining portion together will substantially flatten out the insertion portion and remaining portion closely against each other whereby the flute will more proximately define a well-formed guide-string eye for a mason's guide string.

10. The tool of claim 1 wherein the other jaw further comprises setting means for limiting lateral dislocation of the remaining portion as the jaws are closing on it and forming the flute in it by the impression of the loop therein.

11. The tool of claim 1 further including means for coupling the jaws.

12. A method of producing trigs from metal strips by a hand tool, comprising the steps of:

providing a hand tool having a pair of jaws of which, one jaw is given a loop and the other jaw has a bending means and a slot to match the loop;

inserting an insertion portion of the strip through the loop to establish a single ply on the one jaw;

closing the jaws on the single ply of the insertion portion such that the bending means forms an outer limit of the insertion portion with a remaining portion extending therefrom;

initiating bending of the remaining portion of the strip back upon the insertion portion by bending it about the bending means;

opening the jaws and substantially completing bending of the remaining portion of the strip back upon the insertion portion by alternative means to form two plies of the insertion and remaining portions;

closing the jaws on the two plies of the insertion portion and bent-back remaining portion together; and light hammering on the closed jaws to form a flute in the remaining portion of the strip that conforms closely to what interspace is defined between the loop and slot.

13. The method of claim 12 wherein the alternative means for completing bending of the remaining portion includes bending by hand.

14. The method of claim 12 further comprising forming the loop such that it defines substantially a rectangular aperture scaled for close fitting insertion of the metal strip.

15. The method of claim 12 wherein the bending means includes a corner edge of the other jaw.

16. The method of claim 12 wherein the setting means includes an end-stop for limiting longitudinal dislocation of the insertion portion and edge-abutting guides for limiting lateral dislocation of the insertion portion.

17. The method of claim 12 further comprising providing the slot to define substantially a semi-cylindrical form and to have open ends.

18. The method of claim 12 further comprising shaping and arranging the jaws to close substantially planar upon one another such that light hammering on them while closed upon the two plies of the insertion portion and bent-back remaining portion together will substantially flatten out the insertion portion and remaining portion closely against each other whereby the flute will more proximately define a well-formed guide-string eye for a mason's guide string.

19. The method of claim 12 further comprising providing the other jaw with setting means for limiting lateral dislocation of the remaining portion as the jaws are closing on it and forming the flute in it by the impression of the loop therein.

20. The method of claim 12 further comprising providing each jaw in the form of a block as well as providing means for coupling the blocks for use among various open and closed positions.

* * * * *